US006533629B1

(12) United States Patent
Boehler et al.

(10) Patent No.: US 6,533,629 B1
(45) Date of Patent: Mar. 18, 2003

(54) SPARK PLUG INCLUDING A WEAR-RESISTANT ELECTRODE TIP MADE FROM A CO-EXTRUDED COMPOSITE MATERIAL, AND METHOD OF MAKING SAME

(75) Inventors: Jeffrey T. Boehler, Holland, OH (US); Gary B. Zulauf, Findlay, OH (US)

(73) Assignee: AlliedSignal Inc., Morristown, NJ (US)

( * ) Notice: Subject to any disclaimer, the term of this patent is extended or adjusted under 35 U.S.C. 154(b) by 0 days.

(21) Appl. No.: 09/552,526

(22) Filed: Jul. 13, 1999

(51) Int. Cl.[7] ..... H01T 21/02; H01T 13/20
(52) U.S. Cl. ..... 445/7; 313/141
(58) Field of Search ..... 445/7, 46, 49–51; 313/118, 139, 141; 123/169 EL

(56) References Cited

U.S. PATENT DOCUMENTS

| | | | | |
|---|---|---|---|---|
| 4,093,887 A | | 6/1978 | Corbach et al. | |
| 4,324,588 A | | 4/1982 | Zysk et al. | |
| 4,670,684 A | * | 6/1987 | Kagawa et al. | 313/141 |
| 4,684,352 A | | 8/1987 | Clark et al. | |
| 4,743,793 A | * | 5/1988 | Toya et al. | 313/141 |
| 4,810,220 A | | 3/1989 | Moore | |
| 4,840,594 A | | 6/1989 | Moore | |
| 5,179,313 A | | 1/1993 | Eves et al. | |
| 5,456,624 A | | 10/1995 | Moore et al. | |
| 5,510,667 A | | 4/1996 | Löffler et al. | |
| 5,558,575 A | | 9/1996 | Chiu et al. | |
| 5,574,329 A | | 11/1996 | Kagawa | |
| 5,869,921 A | | 2/1999 | Matsutani et al. | |

FOREIGN PATENT DOCUMENTS

| | | |
|---|---|---|
| GB | 1514195 | 6/1978 |
| GB | 1528514 | 10/1978 |

OTHER PUBLICATIONS

"Development of New Iridium Alloy for Spark Plug Electrodes", Society of Automotive Engineers Publication No. 1999–01–0796, written by Hironori Osamura and Nobou Abe, U.S.A., 1999.

* cited by examiner

*Primary Examiner*—Kenneth J. Ramsey
*Assistant Examiner*—Mack Haynes

(57) ABSTRACT

A method of making a spark plug involves attaching a wear-resistant electrode tip to an electrode, in which the electrode tip incorporates two or more co-extruded metals, in which one of the metals is present in the form of one or more oriented strands disposed in a supportive matrix of the second metal. Preferably, one of the materials used in fabricating the tip is a noble metal, which may be selected from the group consisting of platinum, iridium, and alloys which include one or both of these metals. A wear-resistant spark plug electrode tip according to the invention is preferred to be made in a post or rivet shape, and a rivet is most preferred. A spark plug electrode tip according to the present invention may be attached to the center electrode of a spark plug, to the side electrode, or to both of the center and side electrodes. After a wear-resistant electrode tip according to the invention is attached to a spark plug electrode, the tip may be flattened, or 'coined', to increase the surface area thereof. A spark plug incorporating a tip made by the preferred method is also disclosed.

35 Claims, 5 Drawing Sheets

SPARK PLUG INCLUDING A WEAR-RESISTANT ELECTRODE TIP MADE FROM A CO-EXTRUDED COMPOSITE MATERIAL, AND METHOD OF MAKING SAME

BACKGROUND OF THE INVIENTION

1. Field of the Invention

The present invention relates To spark plugs for use in internal combustion engines. More particularly, the present invention relates to a method of making spark plugs which include wear-resistant electrode tips made from a co-extruded composite material, and to spark plugs incorporating such wear-resistant electrode tips.

2. Decription of the Background Art

Spark plugs are widely used to ignite fuel in internal combustion engines. Spark plug electrodes are subject to intense heat, and to a highly corrosive environment, generated by the exploding air/fuel mixture, To improve durability and erosion resistance, spark plug electrodes must be able to withstand the high temperature and corrosive environment resulting from the chemical reaction products between air, fuel, and fuel additives within a combustion chamber. The same chemical and thermal stresses also affect the interface between the ground electrode and the metal spark plug shell to which the ground electrode is bonded. Where this interface does not consist of a strong bond, these stresses can reduce spark plug performance or even cause the spark plug to fail.

Society of Automotive Engineers paper No. SAEJ312 describes the specification for automotive gasoline used as a fuel in the United States. The gasoline consists of blends of hydrocarbons derived from petroleum: 50–80 percent saturates, 0–15 percent olefins, and 15–40 percent aromatics. Leaded gasoline contains about 0.10 grams of lead per gallon of fuel (0.026 g Pb/liter), and 0.15 percent sulfur. In unleaded gasoline there is about 0.05 grams of lead per gallon (0.013 g Pb/l), 0.1 percent sulfur, and 0.005 g phosphorous per gallon (0.0013 g P/liter).

In addition, there are a number of additives incorporated into gasoline for various reasons. For example, tetramethyllead (TML) and tetraethyllead (TEL) are added as anti-knock agents. Carboxylic acid compounds such as acetic acid are added as lead extenders. Aromatic amines and phenols are added as antioxidants. Organic bromine and/or chlorine compounds are added as scavengers and deposit modifiers. Phosphors and boron-containing compounds are added to reduce surface ignition, preignition, and as engine scavengers. Metal deactivators are added to reduce oxidative deterioration of fiel by metals, such as Cu, Co, V, Mn, Fe, Cr and Pb. In addition, carboxylic acids, alcohols, amines, sulfonates, and phosphoric acid salts of amines are used as nist-inhibiting additives.

Another factor which places a stress on spark plugs in the combustion chamber environment is the use of Exhaust, Gas Recirculation (EGR) back into the combustion chamber, to cool the combustion charge and to improve emissions, particularly by reducing oxides of nitrogen.

The manufacture of copper (Cu) and nickel (Ni) electrodes for spark plugs is a proven art and has been accomplished in various ways. For instance, U.S. Pat. No. 3,803,892 describes a method of producing extruded copper and nickel electrodes from a flat plate of the two materials. U.S. Pat. No. 3,548,472 discloses a method of cold-forming an outer nickel cup-shaped sleeve in several steps, inserting a piece of copper wire into the cup, and then lightly pressing the two materials together. U.S. Pat. No. 3,857,145 discloses a process for making a spark plug center electrode in which a central copper core is inserted into a nickel member and attached thereto by a collar portion, to assure that an electrical flow path is produced.

U.S. Pat. No. 4,093,887 to Corbach et al. discloses a design for a spark plug having a center electrode made of a composite material. In the design for the composite spark plug electrode as taught by this reference, the electrode is about 2.4 mm in diameter, and includes an outer cylindrical metal jacket, which may be made of nickel, a nickel alloy, or a material based on chromium or cobalt. Inside this outer metal jacket, according To the reference, a matrix material of high conductivity, such as copper or a copper alloy, has a plurality of parallel strands embedded therein. The embedded strands are each approximately 0.3 mm in diameter, and are formed from the same material as the outer jacket. The strands are preferred to be seven in number, are placed so that they do not touch each other, and are arranged so as to be distributed essentially uniformly over the cross-section of the matrix material. This reference does not specifically teach or suggest The use of a wear-resistant electrode tip, but rather, teaches that the entire center electrode be made of the described composite material.

The use of certain types of embedded and/or welded-on spark plug electrode tips, which are more wear-resistant than the main body of the electrode, is also known. In recent years, the practice of adding these wear-resistant tips to spark plug electrodes has become favored in the art. Such spark plug electrode tips may be added to the center electrode, to the side electrode, or to both of the center and side electrodes. Such wear-resistant electrode tips are made tougher and more erosion resistant than the balance of the electrodes, and since the wear-resistant electrode tips provide the points where the spark crosses over between the electrodes, they are among the most critical working parts of a spark plug. Sometimes these electrode tips are mechanically flattened out or 'coined', during or subsequent to the attachment thereof to the base electrode, to cover a larger surface area than would otherwise be the case.

Some illustrative examples of patents relating to various wear-resistant spark plug electrode tips, and to spark plugs including such electrode tips may be found in U.S. Pat. Nos. 4,324,588, 4,810,220, 4,684,352, 4,810,220, 4,840,594, 5,179,313, 5,456,624, 5,558,575, 5,574,329, and 5,869,921.

Some of the known wear-resistant spark plug electrode tips incorporate platinum and/or other noble metals, because of their excellent resistance to oxidation and erosion under exposure to a combustion chamber environment. However, platinum is a very expensive raw material, as are the other noble metals, and it is therefore advantageous to strictly control the amount of noble metal which is incorporated into each spark plug.

In addition, the welding together of two dissimilar metals may result in a mismatch of the relative coefficient of thermal linear expansion of each metal. Under high thermal stress, this mismatch can lead to weakening or fracture of the bond between the electrode and the tip, and may even lead to physical separation of the noble metal and base metal.

U.S. Pat. No. 5,510,667 to Loffler et al. discloses a design for a spark plug which incorporates a reinforced electrode tip made of a platinum-nickel fiber composite material. The disclosed material, in this reference, may be a platinum matrix in which nickel fibers are embedded, or a nickel matrix in which platinum fibers are embedded. No specific number of embedded fibers is discussed in this reference, although the drawings appear to show a large number of fibers in the matrix. Alloys, which include platinum and another metal or metals, are not specifically disclosed in this reference.

The Loffler et al. '667 patent cites to a German patent application number 2 508 490 as disclosing a suitable method of making a fiber composite material which is usable to pracice the invention thereof. The above-cited Gernan patent application also corresponds to Great Britain patent application number 1 528 514, filed Feb. 26, 1976. The method taught therein involves loosely placing solid wires inside hollow metal tubes formed from a dissimilar metal than that of the wires, and bundling multiple tubes and wires together, inside of a larger tubular jacket. The placement of the bundled tubes in a metal jacket is followed by cold plastic deformation of the jacket, tubes, and wires together, to produce a composite material. Different end products are obtained, depending on which materials are used for the component parts.

Society of Automotive Engineers Publication No. 1999-01-0796 discusses the advantages of using an alloy of iridiumn and 10% rhodium for a wear-resistant spark plug tip, and the fiber advantages of keeping the diameter of the central electrode small.

Although various designs for spark plugs having wear-resistant electrode tips are known, a need still exists in the art for a method of making a wear-resistant spark plug electrode tip, in which an amount of platinum, inidium, or other noble metal used is strictly controlled for maximum practical efficiency and cost control.

SUMMARY OF THE INVENTION

The present invention provides a method of making a spark plug electrode tip incorporating two or more co-extruded materials, and to a spark plug incorporating a tip made by the preferred method. A wear-resistant spark plug electrode tip according to the invention is preferred to be made in a post or rivet shape, and a rivet is most preferred.

Preferably, one of the materials used in fabricating the tip is a noble metal, which may be selected from the group consisting of platinum, iridium, and alloys which include one or both of these metals. In the wear-resistant electrode tip according to the invention, the noble metals or their alloys are preferred to be present in the form of one or more oriented strands of wire encased in, or evenly interspersed throughout a carrier or matrix metal. The matrix metal is preferred to be a nickel compound.

In the practice of the present invention, the material used for the matrix metal is selected to have a coeffcient of linear thermal expansion which is similar to that of the base metal of the electrode to which the tip is going to be attached. This matching of the matrix metal with the electrode base metal reduces or eliminates separation of the wear-resistant tip from the base electrode.

The oriented strands of wire are preferred to be disposed, within the electrode tip, so as to be parallel to a longitudinal axis thereof. The number of oriented strands of noble metal alloy is preferred to be between 1 and 20 strands.

A wear-resistant spark plug electrode tip according to the present invention may be attached to the center electrode of a spark plug, to the side electrode, or to both of the center and side electrodes. Optionally, in one method of practicing the invention, the tip, in any shape, may be flattened, or 'coined', to increase the surface area thereof.

Accordingly, it is an object of the present invention to provide a method of making a spark plug which includes a wear-resistant electrode tip having a reduced content of a noble metal therein, and to a spark plug which is a product of the method.

It is another object of the present invention to provide a spark plug having at least one wear-resistant electrode tip attached to an electrode thereof, in which the electrode tip is formed from two dissimilar metals and includes at least one oriented strand of a metal compound comprising a noble metal therein, and wherein each oriented strand used is substantially parallel to a longitudinal axis of the electrode tip.

It is a firther object of the present invention to provide a particularly preferred embodiment of a spark plug, including a first wear-resistant electrode tip attached to a center electrode thereof and containing at least one oriented strand therein including a noble metal or a noble metal alloy, the spark plug further including a second wear-resistant electrode tip attached to a ground electrode thereof and containing at least one oriented strand therein including a noble metal or a noble metal alloy.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF THE PREFERRED EMBODIMENT

Overview

Figure 1:
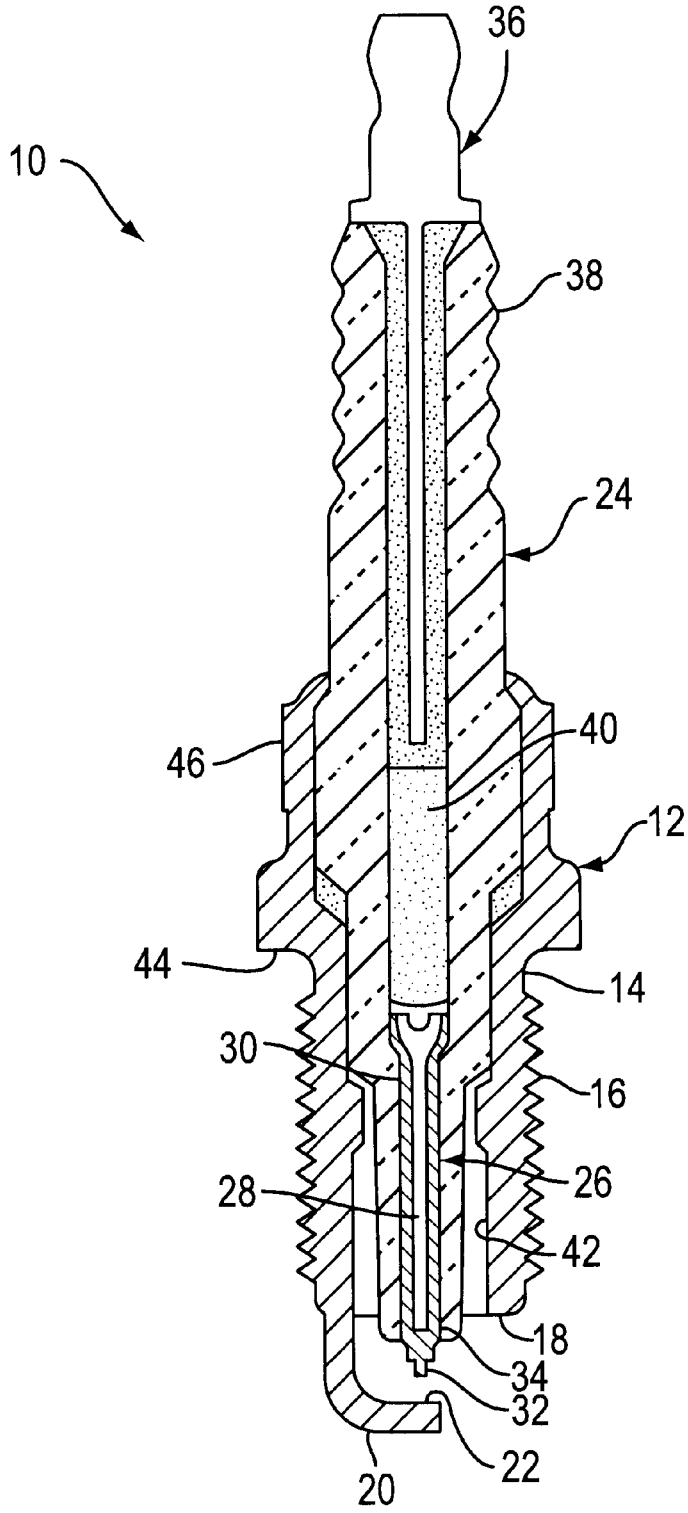
FIG. 1 is a cross-secdonal view of a spark plug in accordance with a first embodient of the present invention, incorporating a wear-resistant electrode tip at each of the center and side electrodes thereof.
Figure 2:
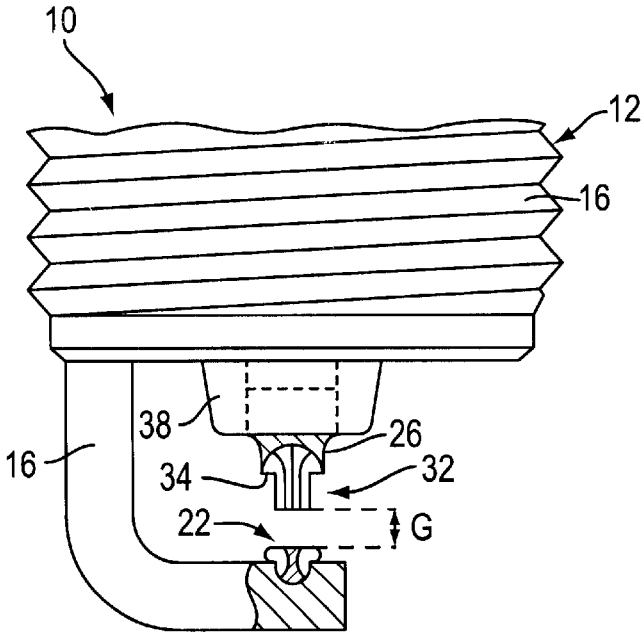
FIG. 2 is a side elevational detail view, partially broken away and partially shown in cross-section, of an end portion of the spark plug of FIG. 1
Figure 3:
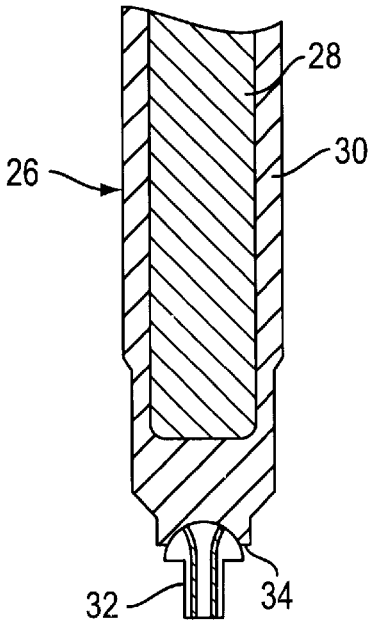
FIG. 3 is a cross-sectional detail view of a center electrode which is one component of the spark plug of FIG. 1, showing a first wear-resistant electrode tip attached thereto in the form of a rivet, in accordance with a preferred embodiment of the invention.

Referring now to the drawings, and particularly to FIGS. 1–3, a spark plug in accordance with the present invention is shown generally at 10. The spark plug 10 includes a metal casing or shell 12 having a cylindrical base 14, which may have external threads 16 formed thereon for threadable engagement in a cylinder head (not shown). The cylindrical base 14 of the spark plug shell 12 has a generally flattened lower surface 18. A ground electrode 20 is welded on to the lower surface 18 of the threaded base 14. In a preferred embodiment of the invention, the ground electrode 16 has a wear-resistant electrode tip 22 welded thereon adjacent the end thereof, as will be further described herein. Throughout the present specification, the terms "ground electrode" and "side electrode" refer to the same component, and these terms are used interchangably.

The spark plug 10 further includes a hollow ceramic insulator 24 disposed concentrically within the shell 12, and a center electrode 26 disposed concentrically within the insulator 24.

The center electrode 26 is preferred to include a central core 28 made of a thermally and electrically conductive material, such as copper or a copper alloy, with an outer cladding 30 which is preferably formed from a nickel alloy. The center electrode 26 is also preferred to have a wear-resistant electrode tip 32 affixed to a lower end 34 thereof An electrically conductive insert or rod 36 fits into the upper end 38 of the insulator 24, opposite the center electrode 26, and a refractory glass-carbon composite material is disposed within the inslulator 24, between the lower end of the insert 36 and the center electrode 26, to provide an internal resistor 40 with the spark plug 10.

The Spark Plug Shell

Referring in particular to FIG. 1, it may be seen that the spark plug shell 12 is a substantially cylindrical sleeve having a hollow bore 42 formed therethrough. As previously noted, the spark plug shell 12 includes a cylindrical base portion 14 which generally has threads 16 formed on the exterior surface thereof The spark plug shell 12 includes a sealing surface 44 for contacting a cylinder head (not shown), and also includes a generally hexagonal boss 46 thereon above the sealing surface, for allowing the spark plug to be grasped and turned by a conventional spark plug socket wrench for installation or removal thereof.

As is well known, it is desirable to maintain the spacing, between the center electrode 26 and the ground or side electrode 20, substantially constant over the life of the spark plug 10. This spacing is hereinafter referred to as the gap G (FIG. 2).

Wear-Resistant Electrode Tips

The wear-resistant tip 32 of the center electrode, in the practice of the present invention, is preferred to be made in the shape of a post or rivet 48.

Figure 4A:
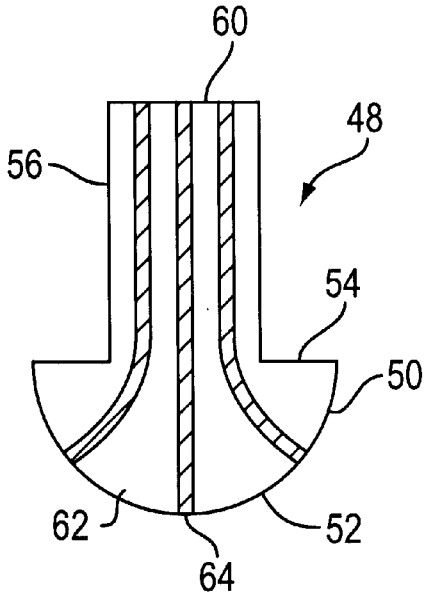
FIG. 4A is a vertical cross-sectional detail view of the first wear-resistant electrode tip of FIGS. 1–3.
Figure 4B:
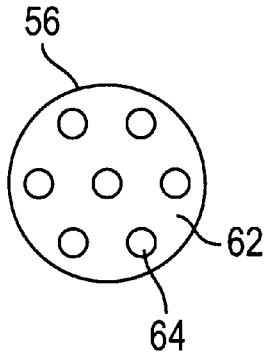
FIG. 4B is a horizontal cross-sectional detail view of the first wear-resistant electrode Tip of FIGS. 1–3.

Referring now to FIGS. 4 and 5, a wear-resistant electrode tip in the form of a rivet 48, according to the present invention, includes a head 50 having a continuous, semi-spherical outer surface 52 and a flat portion 54 opposite the outer surface of the head. A generally cylindrical shank 56 extends from the flat portion 54 and terminates in a generally flattened base 60. The shank 56 is preferred to be made in a range of 0.4–1 mm in diameter. Where the wear-resistant tip takes the form of a post, it resembles the shank 56 of the rivet 48, as shown in FIGS. 4A–4B, with the head 50 removed therefrom.

The wear-resistant spark plug electrode tip 22 or 32 according to the present invention is preferred to be formed from a co-extruded material, in which a first or matrix metal 62 is formed of a nickel alloy. One example of a suitable nickel alloy which may be used for the matrix metal 62, for example, is the alloy of Fe—Ni—Cr sold commercially under the mark "INCONEL".

Preferably, the material chosen for use as the matrix metal 62 has a linear coefficient of thermal expansion which is similar to the linear coefficient of thermal expansion of the base metal used for the balance of the ground electrode 20, so as to be compatable therewith. This allows for harmonious thermal expansion and contraction of the electrode and the tip attached thereto, despite the fact that the material chosen to make up the oriented strand(s) of the tip may have a different linear coefficient of thermal expansion from the electrode base metal. It is preferred that the coefficient of linear thermal expansion of the matrix metal not differ from the coefficient of linear thermal expansion of the electrode base metal by more than 10 percent. Most preferably, the material chosen for the matrix metal is exactly the same alloy as the material used for the base electrode to which the tip is attached. This identity of materials allows for substantially harmonious thermal expansion and contraction of the electrode and attached tip, even where the material of the strand 64 has different properties from the matrix metal.

In the most preferred embodiment of the invention, the material chosen as the matrix metal 62 is the same as the base electrode metal.

The Oriented Strands

Also in the wear-resistant electrode tip 22 or 32 according to the invention, the electrode tip includes at least one, and may include a plurality of oriented strands 64. The oriented strands are made of a second metal which includes at least one noble metal.

As used throughout the present specification and in the claims, the term "noble metal" is intended to include platinum, palladium, rhodium, iridium, ruthenium, gold and silver, as well as alloys and/or mixtures of the above metals with each other and/or with other metals.

The use of these oriented strands 64 allows a manufacturer of spark plugs 10 to carefully control the amount of noble metal used, while preserving the high performance provided by the presence of the noble metal tips. The use of the oriented strands 64, further, allows a spark plug manufacturer to expose a matrix metal 62 that is similar in thernal linear expansion and melting point to the properties of the base metal in the electrode to which the tip is attached, to provide a durable bond therebetween. The oriented strands 64 are distrbuted in the tip 32 substantially in line with the expected direction of travel of the spark.

The rivet is a preferred shape to use with oriented strand tips, because the rivet shape allows for relatively easy and repeatable orientation of the tip 32 with existing tooling. This allows for proper alignment of the oriented strands 64 in the preferred orientation thereof. Spark plugs generally using fine wire rivet firing tips, and methods of attaching such rivet tips electrodes are described generally in U.S. Pat. No. 5,456,624, the disclosure of which is hereby incorporated by reference.

The number of oriented strands 64 used is preferred to be not more than 20, and more preferably, not more than 10. Preferred noble metals for use in oriented strands include platinum and iridium as well as mixtures and alloys of these metals with each other and with other metals. One mixture which is usable for the oriented strands is 85–95% platinum alloyed with 5–15% nickel. Another mixture which is usable for the oriented strands 64 is from about 45 percent to about 85 percent platinum, from about 14 percent to about 60 percent iridium, and from about ½ percent to about five percent tungsten. Preferably, this mixture is present in the ranges of from about 75 percent to about 86 percent platinum, from about 12 percent to about 20 percent iridium, and from about ½ percent to about 5 percent tungsten.

Where more than one oriented strand is used, the strands 64 are preferred to be arranged in a concentric pattern surounding the longitudinal axis of the electrode tip and parallel thereto.

Electrode Tips for Placement on the Ground Electrode

Figure 5A:
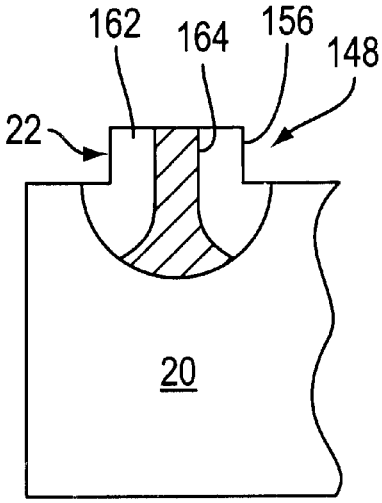
FIG. 5A is a cross-seceional detail view of a spark plug ground electrode, having a second wear-resisrant electrode tip attached thereto according to the embodiment of FIGS. 1–3, shown at a first time.

Referring now to FIG. 5A, an end portion of the side or ground electrode 20 is shown broken away, with a second spark plug electrode tip 22 attached thereto, in the form of a second rivet 148, in which a shank portion 156 of the rivet is substantially shorter than the shank portion 56 of the first rivet 48. In the design of the rivet 148 depicted in FIGS. 5A–5B, only a single oriented strand 164 is present, the single oriented strand disposed as a central core of the rivet 148. The surrounding matrix metal 162 makes up ajacket surrounding the central core of the strand 164. The oriented strand 164 is disposed in line with the longitudinal axis of the rivet 148 which makes up the electrode tip 22.

Optional Coining Process

Figure 5B:
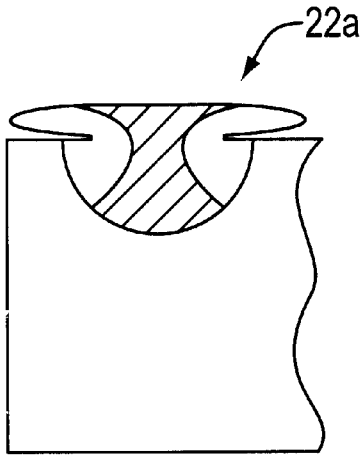
FIG. 5B is a similar view to that of FIG. 5*a*, shown at a second time after the wear-resistant tip has been partially mechanically flattened.

Subsequent to attachment of the electrode tip 22 to either the ground electrode 20, the center electrode 26, or both of these, and as shown in FIG. 5B, the electrode tip 22 may be mechanically flattened or 'coined'. Where used, this mechanical flattening action increases the surface area of the exposed portion of the oriented strand 66. While the tip 22*a* is shown partially flattened at an intermediate stage in FIG. 5B, mechanical flattening will continue until the upper surface of the tip 22 is substantially flat and even, to provide a constant gap G between the electrodes.

In the flattened electrode tip 22*a*, the combination of the rivet shape and the oriented strand 66 therein allows for maximization of the accessible surface area of the material of the oriented strand, while preserving a spark path therethrough. This advantageously gives maximum benefit from the noble metal content of the tip 22, while carefully controlling the amount of noble metal therein to preserve and maximize resources.

After all desired electrode tips are attached to the electrodes, and after any desired coining of the tips is complete, the remainder of the spark plug 10 is assembled in the standard fashion.

Methods of Practicing the Invention

Figure 6:
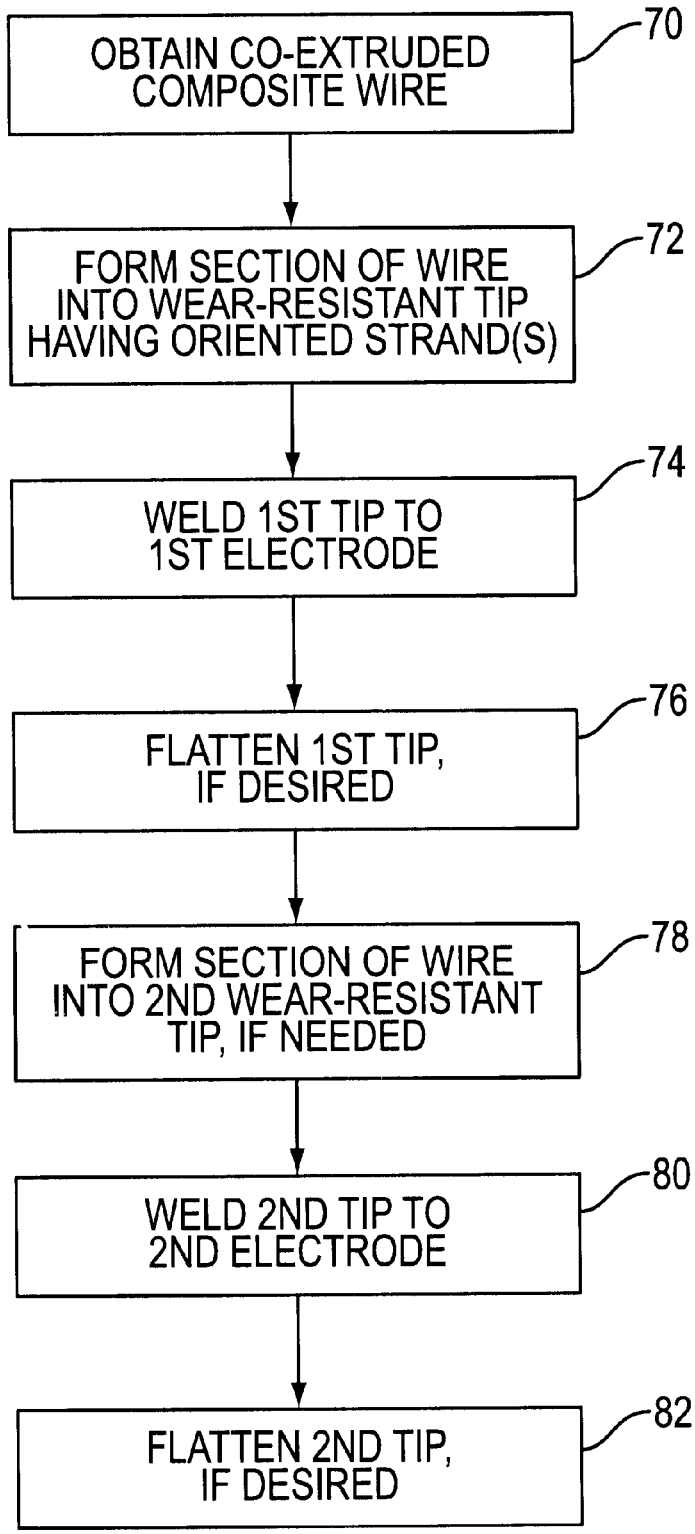
FIG. 6 is a flow chart of steps which may be used in the practice of a first preferred method according to the present invention.
Figure 7:
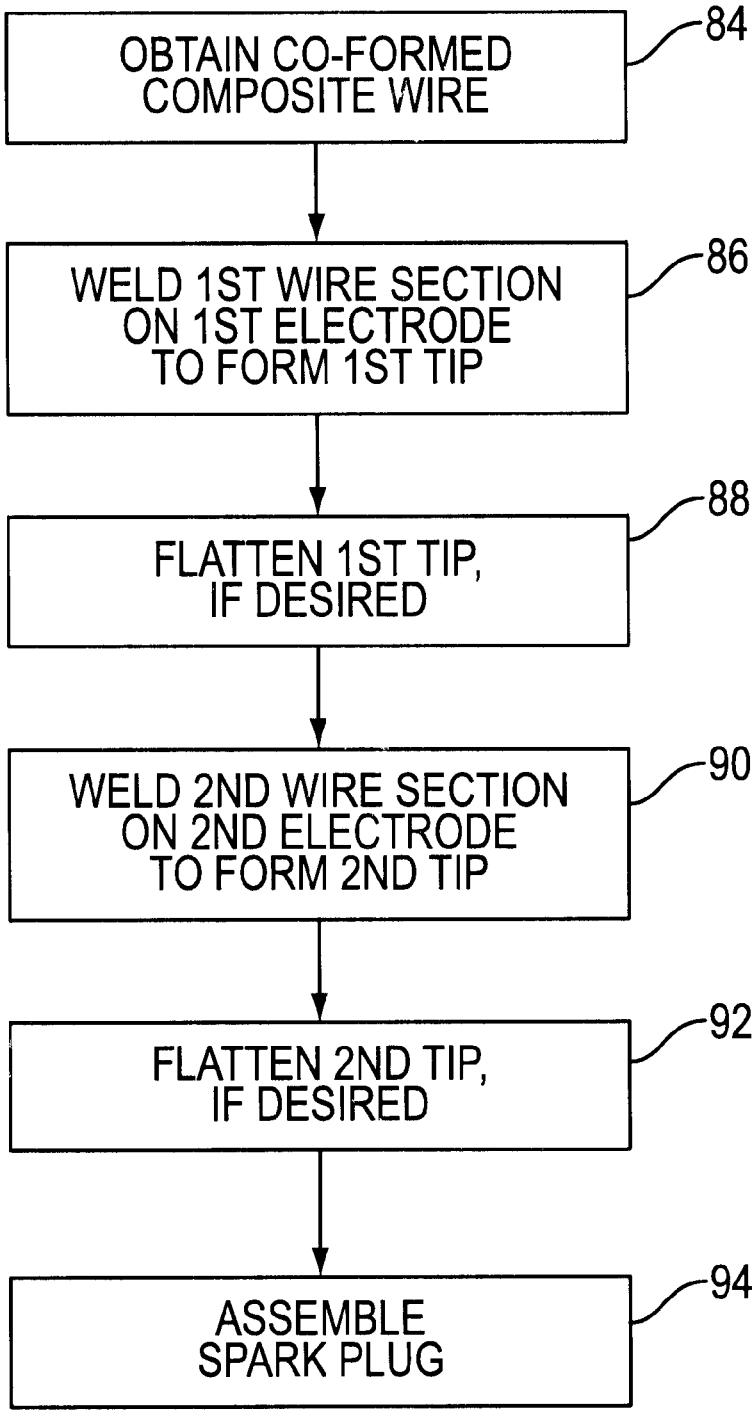
FIG. 7 is a flow chart of steps which may be used in the practice of a second preferred method according to the present invention.

Referring now to FIG. 6, a first preferred method of producing a spark plug 10 in accordance with the invention includes a first step 70 of obtaining or providing a composite wire in which a noble metal or alloy thereof has been co-extruded, in the form of one or more oriented strands, with a matrix metal as described above.

In the preferred method according to the invention, this composite wire is formed by a process which involves drilling holes in a solid block of a matrix metal, which is selected to be thermally compatible with the base metal of an electrode to which a tip will be attached. In a particularly preferred embodiment, as previously noted, the matrix metal may be the same as the metal used for the base electrode to which the final tip is attached.

Then, solid wire sections of wear-resistant metal, which preferably comprises a noble metal, are inserted into the holes formed through the solid matrix metal block. Then, through standardized cold forming processes, the comosite block of matrix metal, with the wires therein, is formed into a long wire of composite material having one or more internal strand(s) of the noble metal alloy therein.

In the first preferred embodiment of a method according to the invention, as sumarized in FIG. 6, a first wire section is then cut from the bulk wire. The first section of the wire is formed into a first wear-resistant tip in the next step 72. The first wear-resistant tip may be a rivet, such as the rivets showvn at 48, 148, or alternatively, the first tip may be a cylindrical post which is analagous to the shank portion 56 of the spark plug electrode tip 32, with the head removed therefrom. In forming the rivet, the material of the head 50 is compressed and deformed from its original shape. This will have some tendency to spread the portion of the strands 64 inside the rivet head 50 outwardly within the rivet head, as shown in FIGS. 4A and 5A This spreading out of The strands 64 is acceptable in the practice of the invention.

Care should be taken, however, to retain the orientation of the strand(s) in the slhnk 56 of the final rivet or the post, to remain substantially parallel to the longitudinal axis thereof.

The next step 74 is to weld a first tip to an end portion of a first electrode. This first electrode may be either the center electrode 26 or the side electrode 20.

Where a first tip is being welded to the center electrode 26, the tip is aligned so that the oriented strand(s) thereof are kept substantially parallel to the longitudinal axis of the center electrode, in the assembly of the two components.

In contrast, where the first tip is being attached to the side electrode 20, the side electrode is intitially attached to the lower surface 18 of the shell base 14 in a straight line orientation thereof, which is substantially parallel to the center electrode, and the side electrode is later bent to form substantially a right angle, as is shown in FIG. 1. I this case, the first tip is preferably attached to the side electrode 20 with the oriented stand(s) therein lined up substantially at a right angle to the longitudinal axis of the side electrode, so that when the side electrode is bent into the standard right angle configuration, the strand(s) will line up substantially parallel to the longitudinal axis of the center electrode, and substantially in line with the expected direction of spark travel therethrough.

After this bending is complete, where both electrodes carry electrode tips, the oriented strand(s) of the tip on the ground electrode are lined up to be substantially parallel to the oriented strands of the tip on the center electrode.

Then, in the next step 76, if a flat electrode tip is desired, the tip may, optionally, be flattened in place on the electrode.

Where only a single wear-ressant tip is desired in the finished product, the first electrode 20 or 26, with its attached wear-resistant tip thereon, may be assembled into a finished spark plug following standard procedures and using standard components for the balance of the parts.

Where a second wear-resistant tip is desired to be placed on a second electrode such as the ground electrode 20, it may be formed in a separate step 78. Alteratively, both tips may be formed together in advance in step 72. In either case, the second tip may be attached to the second electrode in an additional step 80 of the method.

If the particular application is one in which a flattened second electrode tip is desired, the second tip may be flattened at this stage in step 82.

In one embodiment of the method hereof, both wear resistant tips 22, 32 may be left in the form of rivets 48, 148, with the substantially cylindrical shafts thereon left intact. In this embodiment, the components of the spark plug 10 are then assembled together in the normal way.

In another embodiment of the invention, after the tip(s) are attached to the respective electrode(s), either or both of the tips may be mechanically flattened.

The Modified Method

In a second preferred method according to the invention, in the first step 84 of the method, the co-formed composite wire is obtained, exactly as in the first method. In the next step 86, a first portion of the above-described composite wire is welded directly from a spool or length thereof on to a fist electrode to form a first wear-resistant tip thereon. The first electrode may be a center electrode 26 or a ground electrode 20. After being so welded, the first tip may be mechanically flattened, if desired, in a subsequent optional step 88.

Where only a single wear-resistant electrode tip is needed, the spark plug may then be assembled in the normal way.

Alternatively, where a second wear-resistant electrode tip is also needed, a second portion of the above-described composite wire is welded, in another step 90, directly from the same spool or length thereof on to a second electrode to form a second wear-resistant tip thereon. The second electrode may be a center electrode 26 or a ground electrode 20, and compliments the first electrode. After being so welded, the second tip may be mechanically flattened, if desired, in another subsequent optional step 92.

After attaching the second wear-resistant electrode tip, and flattening the tip if a flat tip is desired, the spark plug 10 may then be assembled in the normal way.

Although the present invention has been described herein with respect to several preferred embodiments thereof, the foregoing description is intended to be illustrative, and not restrictive. Those skilled in the art will realize that many modifications of the preferred embodiment could be made which would be operable. All such modifications which are within the scope of the claims are intended to be within the scope and spirit of the present invention.

I claim:

1. A method of manufacturing a spark plug, comprising the steps of:

a) providing a length of wire formed from a co-extruded composite material comprising a first metal consisting of a matrix metal which is a nickel alloy, interspersed with a second metal consisting of an oriented strand metal comprising a noble metal;

b) forming a section of the wire into a wear-resistant spark plug electrode tip having a substantially cylindrical shaft portion having a longitudinal axis;

wherein the cylindrical shaft portion includes at least one strand therein which is substantially parallel to the longitudinal axis thereof; and c) attaching the wear-resistant spark plug electrode tip to a spark plug electrode.

2. The method of claim 1, wherein the second metal is present as a central core and the first metal makes up a jacket surrounding the central core of the first metal.

3. The method of claim 1, wherein the second metal is present as a plurality of parallel strands disposed in a concentric pattern within the first metal.

4. The method of claim 3, wherein said parallel strands are present in a quantity not exceeding 20.

5. The method of claim 3, wherein said parallel strands are present in a quantity not exceeding 10.

6. The method of claim 5, wherein said second metal comprises an alloy containing platinum, iridium, and tungsten.

7. The method of claim 1, wherein the spark plug electrode is made of a material which has a measurable linear coefficient of thermal expansion, and further wherein the first metal has a linear coefficient of thermal expansion which is substantially similar to the linear coefficient of thermal expansion of the material of the electrode to which the tip is attached.

8. The method of claim 1, wherem the second metal comprises platinum.

9. The method of claim 8, wherein the second metal comprises an alloy comprising platinum, iridium, and tungsten.

10. The method of claim 1, wherein the second metal is an alloy comprising 80–95% platinum and 5–20% nickel.

11. The method of claim 1, wherein the second metal comprises inidium.

12. The method of claim 1, further comprising a step of forming a wire section into a rivet before attachment thereof to the spark plug electrode.

13. The method of claim 1, wherein the first metal is an alloy of nickel, chrome and iron.

14. The method of claim 1, wherein said second metal comprises platinum.

15. A spark plug which is a product of the method of claim 1.

16. A method of making a spark plug which includes a wear-resistant tip on an electrode thereof, comprising the steps of:

a) obtainig a wire formed from a composite material which comprises a first metal comprising nickel, interspersed with a plurality of parallel strands of a second metal which comprises a noble metal; and b) attaching a section of said wire to a first spark plug electrode to form a wear-resistant tip thereon.

17. The method of claim 16, further comprising a step of forming a section of the wire into a rivet, having a shaft and a rivet head attached to the shaft, before attaching the wire section to the first spark plug electrode.

18. The method of claim 17, wherein the rivet shaft is substantially cylindrical, and wherein said strands are disposed in a substantially concentric pattern in said rivet shaft.

19. The method of claim 18, wherein said rivet contains a number of said strands not exceeding 10.

20. The method of claim 19, wherein said first spark plug electrode is a center electrode.

21. The method of claim 20, further comprsing a step of attaching a second rivet to a second electrode of said spark plug.

22. The method of claim 21, further comprising a step of mechanically flattening said second rivet after attachment thereof to said ground electrode.

23. A method of manufacturing a spark plug, comprising the steps of:

a) providing a length of wire formed from a co-extruded composite material comprising a first metal consisting of a matrix metal which is a nickel alloy, interspersed with a second metal consisting of an oriented strand metal comprising a noble metal;

b) attaching a section of the wire on to an electrode to form a wear-resistant spark plug electrode tip having a substantially cylindrical shaft portion, the shaft portion having a longitudinal axis;

wherein the shaft portion includes at least one strand therein which is substantially parallel to the longitudinal axis thereof; and c) attaching the wear-resistant spark plug electrode tip to a spark plug electrode.

24. The method of claim 23, further comprising a step of mechanically flattening The electrode tip on the electrode.

25. A spark plug, comprising:

a base including a substaftially cylindrical threaded portion for threadable engagement in a cylinder head of an internal combustion engine, a ground electrode attached to an end of the base;

a ceramic insulator disposed coaxially in-the base, and a center electrode disposed coaxially in the ceramic insulator;

wherein at least one of said ground electrode and said center electrode has a wear-resistant tip attached thereto;

said wear-resistant electrode tip being formed from a co-extruded composite material, including a matrix metal, and at least one strand of a strand material, comprising a noble metal disposed within the matrix metal.

26. The spark plug of claim 25, wherein the strand material comprises platinum.

27. The spark plug of claim 25, wherein the strand material comprises iridium.

28. The spark plug of claim 25, wherein the strand material comprises platinum, iridium, and tuxgsten.

29. The spark plug of claim 28, wherein the strand material consists of a metal comprising from about 45 percent to about 85 percent platinum, from about 14 percent to about 60 percent iridium; and from about ½ percnt to about four percent tungsten.

30. The spark plug of claim 28, wherein the material of the strand consists of a metal comprising from about 75 percent to about 86 percent platinum, from about 12 percent to about 20 percent iridium, and from about ½ percent to about 5 percent tungsten.

31. The spark plug of claim 25, wherein the spark plug tip is mechanically flattened.

32. A spark plug, comprising:

a base including a substantially cylindrical threaded portion for threadable engagement in a cylinder head of an internal combustion engine, a ground electrode attached to an end of the base;

a ceramic insulator disposed coaxially within the base, and a center electrode disposed coaxially inside the ceramic insulator;

wherein at least one of said ground electrode and said center electrode has a wear-resistant tip attached thereto;

said wear-resistant electrode tip being formed from a co-extruded composite material including a matrix metal, and a strand disposed within the matrix metal, the strand comprising a noble metal;

wherein the strand is present as a central core and the matrix metal makes up a jacket surrounding the strand.

33. A spark plug, comprising:

a base including a substantially cylindrical threaded portion for threadable engagement in a cylinder head of an internal combustion engine, a ground electrode attached to an end of the base, said ground electrode comprising a ground electrode base metal;

a ceramic insulator disposed coaxially within the base, and a center electrode disposed coaxially inside the ceramic insulator and comprising a center electrode base metal;

wherein at least one of said ground electrode and said center electrode has a wear-resistant tip attached thereto;

said wear-resistant electrode tip being formed from a co-extruded composite material including a matrix metal, and a strand disposed within the matrix metal, the strand comprising a noble metal;

wherein the matrix metal is selected to be thermally compatible with the ground electrode base metal or with the center electrode base metal.

34. The spark plug of claim 33, wherein the base metal of the ground electrode has a first linear coefficient of thermal expansion, and wherein the matrix metal of the tip has a second linear coefficient of thermal expansion which does not differ from the first linear coefficient of thermal expansion by more than 10% thereof.

35. The spark plug of claim 33, wherein the matrix metal is the same as the base metal of the electrode to which it is attached.

* * * * *